United States Patent [19]

Perie

[11] 3,990,497

[45] Nov. 9, 1976

[54] PROCESS FOR PRODUCING STEEL INGOTS

[75] Inventor: Rene Gaston Perie, Hagondange, France

[73] Assignee: Societe Anonyme dite: Sacilor — Acieries et Laminoirs de Lorraine, Hayange, France

[22] Filed: Nov. 18, 1974

[21] Appl. No.: 524,809

[30] Foreign Application Priority Data

Nov. 22, 1973 France ..... 73.41663

[52] U.S. Cl. ..... 164/56; 164/66; 164/123

[51] Int. Cl.[2] ..... B22D 27/20

[58] Field of Search ..... 164/56, 57, 58, 66, 164/122, 123

[56] References Cited

UNITED STATES PATENTS

| | | | |
|---|---|---|---|
| 3,208,117 | 9/1965 | Goedecke et al. | 164/56 |
| 3,688,831 | 9/1972 | Daws et al. | 164/123 X |
| 3,865,643 | 2/1975 | Bales et al. | 164/56 X |

FOREIGN PATENTS OR APPLICATIONS

| | | | |
|---|---|---|---|
| 1,458,941 | 5/1970 | Germany | 164/56 |
| 37,438 | 11/1970 | Japan | 164/56 |

*Primary Examiner*—Francis S. Husar
*Assistant Examiner*—John E. Roethel
*Attorney, Agent, or Firm*—Lewis H. Eslinger

[57] ABSTRACT

A process of producing steel ingots having a steel composition at the skin which differs from that at the heart comprises tapping incompletely killed steel from a tapping ladle into an ingot mould, adding a deoxidizing agent to the steel in the mould, intensively mixing the steel for a period in minutes equal to at least half the height of the ingot in meters and decanting the inclusions in the steel, both the intensive mixing and decant taking place during the basaltic crystallization phase.

11 Claims, No Drawings

PROCESS FOR PRODUCING STEEL INGOTS

BACKGROUND OF THE INVENTION

The present invention relates to a process of producing steel ingots particularly composite steel ingots having, at the skin, a steel composition which is different from that of the heart, a process in accordance with which an incompletely killed steel, mainly effervescing, rimming or semi-killed steel, is first of all treated in the tapping ladle, and it is then tapped into an ingot mould, if need be dead-headed, after filling the ingot mould and the passage of a predetermined time, a deoxidizing agent is added to the steel in the ingot mould and the said steel is subjected to mixing under the effect of a gas injected into the steel near the bottom of the ingot mould. The invention also includes such a steel ingot.

A known process of the type mentioned above has the disadvantage of not preventing, in the solidified ingot, the numerous non-metallic inclusions existing normally in the steel or the inclusions made up by the residues of deoxidation which are prejudicial to the use of the ingots obtained or which lead more or less to an important percentage of scrap.

It has already been proposed to effect the mixing of steel for an extremely short period of time, less than 30 secs, in order not to assist too much a rapid crystallization of the steel outside the solidification front, which crystallization, as is known, impedes or prevents the decanting of the inclusions at the surface of the ingot. Now it has been ascertained that a mixing of a very short duration such as proposed up to the present does not permit the efficient decanting of the deoxidation residues such as the oxides of aluminium and/or of silicon which are then of a volume which is too small to be able to decant rapidly.

In another process of the same type, with a view to ensuring a good homogeneity of the steel, it has been proposed to maintain the mixing of the steel by neutral gas until the said steel has become very rich in crystals. This manner of proceeding certainly reduces the number of inclusions, but those which remain entrapped are voluminous such that the ingots obtained are of mediocre quality.

SUMMARY OF THE INVENTION

It is an object of the invention to suppress the above mentioned disadvantages and to provide a process of producing ingots of the type defined at the start, which process allows composite ingots substantially free from all troublesome inclusions to be obtained.

According to a first aspect of the invention, there is provided a process of producing a composite steel ingot having a steel composition at the skin which differs from the steel composition at the heart, said process comprising the steps of tapping an incompletely killed steel from a tapping ladle into an ingot mould, adding a deoxidizing agent to said incompletely killed steel in said ingot mould, and, during a basaltic crystallization phase of said steel in said ingot mould, intensively mixing said steel in said ingot mould for a period in minutes equal to at least half the height of said ingot in meters and decanting inclusions in said steel in said ingot mould.

According to a second aspect of the invention, there is provided a composite steel ingot comprising a skin of effervescent steel and a heart of semi-killed steel.

DESCRIPTION OF THE PREFERRED EMBODIMENT

Basically the invention proposes that the addition of the deoxidizing agent in the ingot mould and the intense mixing of the steel take place during the basaltic crystallization phase of the steel and that the intense mixing lasts after the sald addition for a time expressed in min. at least equal to half the height of the ingot expressed in *m*.

Thus there is assured at the same time a homogeneous distribution of the deoxidizing agent, the entrainment of the inclusions by the gases and their aggregation in amounts of substantial volume are assisted, which, after the stopping of the mixing, at a moment when the steel no longer contains a noticeable quantity of crystals since the equiaxial crystallization only intervenes after the basaltic crystallization, can be decanted rapidly because they rise the surface of the ingot.

The process in accordance with the invention permits the realization of composite ingots of excellent quality whose composition at the skin depends on the composition of the steel in the tapping ladle and whose composition at the centre in addition depends on the nature of the deoxidizing agent and possibly of other additions added at this time to the steel in the ingot mould.

Thus one can take a steel which is incompletely killed in the ladle, therefore having a good tapping capacity, to obtain, by an addition of aluminium in the ingot mould, a perfectly killed steel in the ingot mould and having a predetermined aluminium content. It is also possible to take an effervescent steel which, after having been tapped into the ingot mould and having received, after a delay, an addition of aluminium, gives an ingot having a skin of effervescent steel and a heart of killed steel. A steel having already received in the ladle an addition of silicon can be used and there can be added to this steel, once tapped in the ingot mould, a certain quantity of aluminium which gives an ingot having, on the one hand, a skin containing silicon but practically devoid of aluminium, alumina or aluminates, and, on the other hand, a heart of killed steel. It is also advantageous to make use of the process in accordance with the invention, starting from a steel which is effervescent in the ladle, which steel has with regard to its carbon and manganese content, the composition of a semi-killed steel, to realize a semi-killed steel in the ingot mould by adding to the tapped steel in the ingot mould a deoxidizing agent containing silicon; when the general characteristics of the process in accordance with the invention are regarded, there is then obtained an ingot having a fine skin of effervescent steel and a heart of semi-killed steel.

It has been ascertained that basaltic crystallization, commencing immediately at the end of the tapping and being translated by a solidification of the steel only starting from and perpendicular to the side of the ingot mould and from the base plate, permits the control, at least approximately, of the thickness of the skin of the ingot of effervescent steel. In fact the thickness of the skin is a function of the time passing between the moment when the steel comes into contact with the ingot mould and that of the addition of a deoxidizing agent into the ingot mould. The influence of the artificial mixing of the effervescent steel only plays a secondary role. But it is important that this time be reduced to the minimum compatible with the desired thickness of the skin in order to allow sufficient time to exist for the intense mixing of the steel before the end of the basaltic crystallization phase which is followed by the equiaxial crystallization phase. Now it is known that, during the equiaxial crystallization, the thickness of solidified steel increases in a manner which is quite uncontrollable, and, what is more serious, the steel crystals forming in the course of this equiaxial crystallization phase prevents any efficient decanting of the deoxidation residues.

It has been ascertained that the duration of the basaltic crystallization phase of the liquid steel subjected in an ingot mould to a violent mixing cannot be determined with accuracy. Nevertheless it has been found that the period of basaltic crystallization is approximately proportional to the height of the filling of the ingot mould, that is to say to the height $h$ of the ingot. It has also been found that the proportionality factor correlating the duration of the period of basaltic crystallization to the height of the ingot is generally greater than 2. In practice one can fix an empirical time $T_E$ which determines the operative period at the end of which the intense mixing of the steel must be stopped in order to permit the inclusions to decant perfectly before the end of the period of basaltic crystallization. In a first approximation, the value of this operative period is evaluated by the formula:

$$T_E = 2.h$$

$h$ being the height of the ingot in $m$, $T_E$ being the duration of the operative period expressed in min, starting from the end of the tapping into the ingot mould and comprising a waiting time $T_A$, a time for the addition of the deoxidizing agents $T_D$ and a mixing time $t_B$.

It will now be understood that the time available for the intense mixing of the steel is limited, but that it must be sufficient (at least $h/2$ in min, $h$ being in $m$) to ensure the aggregation of the deoxidation residues in more substantial amounts capable of rising rapidly and easily to the surface of the liquid steel once the mixing has stopped.

The thickness $e$ of the skin forming before the addition of a deoxidizing agent is approximately determined by the formula:

$$e = k\sqrt{t_A}$$

$k$ being a factor between 22 and 25, according to whether the steel is respectively found in the intensive mixing state or only in the state of effervescence, $t_A$ being the duration in min of the waiting time between the end of the tapping at the point considered and the addition of the deoxidizing agent, $e$ being expressed in mn.

To realise ingots free from inclusions, it will have to be arranged that the mixing time $t_B$ is at least equal in min to $h/2$ $h$ being expressed in m, and that $t_A + t_D + t_B$ is at maximum equal to $t_E$, the time $t_A$ being to a certain extent a function of the thickness of the skin $e$ which is required to be obtained and the time $t_D$ being generally limited to several tens of seconds.

In general for a normal height $h$ of ingot of two meters, the total time $t_E$ available for the formation of skin, the addition of deoxidizing agent and the mixing does not exceed 4 minutes. If the intense mixing lasts a minute after the addition of the deoxidizing agent, a thickness of skin $e$ can be obtained whose value is determined by the above-mentioned formula, in which $t_A$ is almost equal to three minutes due to the fact that $t_D$ only lasts, for example, for 10 to 15 seconds. According to when during this period, the liquid steel is strongly mixed or is only weakly or not mixed at all, the thickness of the skin $e$ of effervescent steel will vary between approximately 38 and 44 millimeters at the head of the ingot.

It should again be noted that the duration of the basaltic crystallization period increases with an increase in the rate of tapping and of the temperature of the steel at the moment of tapping. Nevertheless, this duration always remains limited and this is the more so when the mixing is more violent. An intense mixing in fact increases the rate of cooling of the liquid steel which is found at the heart of the ingot and thus advances the initiation of the equiaxial crystallization phase. One can therefore neglect during a first approach of the duration of the basaltic crystallization the opposed influences of the temperature of the steel and of the rate of tapping on the one hand, and the intensity and the duration of mixing on the other hand. Let it again be noted that the duration of the period of basaltic crystallization also depends on the nature and on the quantity of deoxidizing agent added to the liquid steel and on the moment of the addition of the deoxidizing agent.

To determine empirically the duration of the basaltic crystallization period, there is interest in proceeding with a series of experiments for each type of steel made and for each type of ingot mould used, starting from the formula $t_E = 2.h$. If the ingots obtained contain many more inclusions at the foot than at the head, the value of $t_A + t_D + t_B$ allowed to be greater by the formula $t_E = 2.h$ will have to be reduced, for example by one or several tens of seconds, for in this case the mixing has been clearly determined after the end of the basaltic crystallization phase. If, on the other hand, inclusions are only found at the head of the ingot, one can, by a slight increase in the value of $t_E$ (for example by about ten seconds, sometimes more), increase the mixing time $t_B$ and thus improve the decanting of several inclusions at the extreme head. Let it be noted that it is not always necessary to have $t_A + t_D + t_B = t_E$. It is sufficient that the conditions: $h/2 \leq t_A + t_D + t_B \leq T_E$ $h$ being expressed in meters.

As deoxidizing agent added to the steel in the ingot mould, aluminium, silicon, ferrosilicon or even complex deoxidizing agents such as silicomanganese, silicoaluminium, silicocalcium etc. can be used.

When it is a question of producing ingots of semi-killed steel, it is advantageous to effect a prior deoxidation in the ingot mould with the help of a predetermined quantity of aluminium and to complete the deoxidation until the content of oxygen corresponds to semi-killed steel with the help of a deoxidizing agent containing silicon such as ferrosilicon. Nevertheless, in this case, it is necessary to take care that the quantity of aluminium used is low in order not to totally kill the steel, the content of oxygen of the steel being reduced to the desired value by the addition of the deoxidizing agent containing silicon. In addition, the addition of the deoxidizing agent containing silicon will only take place after the larger part of the products of the prior deoxidation, which products are rich in alumina, are raised to the surface under the influence of the intense mixing which is made to start on the addition of aluminium.

This manner of proceeding is very advantageous for it permits not only very rapid control, with great precision, of the content of oxygen in the final steel, but it also gives a steel still more clean than that obtained with the single addition of a deoxidizing agent containing silicon. In fact the inclusions rich in aluminium decant more rapidly ahd more completely than the inclusions of silicate in the course of the intense mixing of the steel in such a manner that there is the possibility of using the silicon-containing deoxidizing agent in a quantity which is as weak as possible with a view to perfecting up to the degree desired, the deoxidation effected previously with the help of aluminium without running the risk of lowering too far the content of oxygen of the steel by an addition of aluminium which is too great.

As indicated above, the intense mixing is necessary for the requirements of the invention only during the basaltic crystallization phase and after the addition in the ingot mould of deoxidizing agents, but a prior weak mixing or even an intense prior mixing of the steel can be effected before the addition of a deoxidizing agent. However in this case this prior mixing of the steel is only the consequence of one aim followed and not the means permitting this aim to be attained.

In effect the principal aim of attaining by the intense mixing of steel after the addition of a deoxidizing agent, particularly one containing a silicon or aluminium, is to ensure the homogeneous distribution of the deoxidizing agent in the steel and to collect as rapidly as possible the fine particles of the deoxidation residues in amounts of fine particles to form particles of substantial dimensions. In fact, if in the course of the mixing, one part of the deoxidation residues rises to the surface of the ingot and remains there, very numerous particles are entrained, by the mixing, into the interior of the ingot. These particles ought to be rapidly decanted by rising to the surface of the ingot after the stopping of the mixing. However this is possible only if the particles have achieved substantial dimensions. It is notably the intense mixing after the addition of the deoxidizing agents which leads to the formation of aggregation of fine particles in such a manner that these amounts of deoxidation residues of relatively large dimensions rise rapidly to the surface of the ingot, it being understood, during this process, that the steel is still in the basaltic crystallization phase and that the amounts do not meet on their paths numerous steel crystals.

In fact, the presence of crystals in the steel considerably disturbs the rising of the deoxidation residues (inclusions) which should be able to take place rapidly after the end of the mixing. If for example, the steel contains, at the end of the mixing a considerable quantity of crystals, an inclusion found, at the end of the mixing, towards the centre of the ingot will meet, as soon as it starts to rise, crystals, which will stick on to it. The density of the amount formed by the inclusion enveloped by crystals of metal grows little by little until attaining, then exceeding, that of liquid steel. The inclusion ceases to rise and starts to descend towards the foot of the ingot. If the mixing has not been sufficiently long and intense and if it was only stopped during the equiaxial crystallization phase following that of basaltic crystallization, there is then obtained ingots which have not only numerous inclusions which have not been able to be decanted but also a more substantial number of inclusions at the foot than at the head of the ingot.

Taking into account the basic role which the intense mixing plays after the addition of the deoxidizing agent and before the end of the basaltic crystallization phase, it is equally important to be able to employ the said intense mixing as soon as the said addition has been realised.

In order to effect the intense mixing of the steel in the ingot mould, different known mixing devices can be used such as porous brick embedded in the base plate of the ingot mould and connected, on the opposite side to the said ingot mould, to a source of mixing gas, an insufflation lance deeply immersed in the steel of the ingot mould or even tubes traversing the base plate or the ingot mould, opening into the said ingot mould near its bottom and connected at the other extremity to a source of mixing gas, or even tubes simply placed between the base plate and the ingot mould in grooves made in the base plate and/or in the base of the ingot mould, these tubes being also connected to a source of mixing gas the flow of which is controllable. In the present case, only the mixing devices of the type comprising a porous brick in the base plate or tubes emptying into the ingot mould near the base plate can give entire satisfaction. In fact when one requires to obtain in a short time the rising of the largest part of non-metallic inclusions contained in the liquid steel in the ingot mould, whether it is a question of inclusions existing normally in the steel or inclusions formed as a consequence of a deoxidizing agent in the ingot mould, it is necessary to cause an energetic and intense mixing involving the whole mass of the steel contained in the ingot mould. To obtain a good mixing it is necessary to introduce the mixing gas into the steel at the bottom part of the ingot mould nearest the base plate. If a porous brick integral with the plate or tubes emptying into the ingot mould next to this plate are used, very efficient mixing is obtained.

The flow and the pressure of the mixing gas are also important. In a general manner and for ingots of 2 m high approximately, the flow comprises between 5 l/min and 20 l/min per tonne of steel treated during the intense mixing. Not only the pressure of the mixing gas is, of course, greater than the hydrostatic pressure of the steel contained in the ingot mould, but the high pressures, that is to say attaining and exceeding 10 bars can be desirable, in particular when risks of emptying the insufflation orifices have been revealed.

It has been ascertained that the flow of gas necessary was approximately proportional to the weight of the ingot and inversely proportional to its height and that it could be roughly evaluated by the formula:

$$\phi = 25\ (P/h)$$

$\phi$ being the flow in liters per minute.
$P$ being the weight in tonnes
$h$ being the height in meters.

Nevertheless the value given by this formula is only a first approximation and always the stronger flow compatible with the absence of substantial splashing is used in order to obtain a mixing which is as intense as possible.

In order to be able to start up the intense mixing immediately after the addition of the deoxidizing agents in the ingot mould, it is necessary to see that the openings of the insufflation tubes or the pores of the brick fixed in the base plate are not choked. It is therefore advantageous to feed mixing gas to the insufflation tubes or the porous brick already during the tapping of the steel and before the addition of the deoxidizing agent. However, during this period coming to an end with the addition of the deoxidizing agent, the flow of mixing gas can be relatively slight without any inconvenience and not exceed 5 l/min per tonne of steel contained in the ingot mould, the pressure of the gas then only being several tens or bars greater than the hydrostatic pressure and just sufficient to prevent the blockage of the openings of the insufflation tubes or the pores of the porous brick. One then has a bubbling affair and not an intense mixing of the steel.

In particular, this bubbling will be necessary when one separates the semi-killed or incompletely killed steel in the ladle to avoid the solidification of the upper surface of the metal which, with the absence of any bubbling, supervenes just after the end of the tapping. This necessity does not exist obviously with effervescent steel which is naturally agitated by the gaseous emission which are produced spontaneously in the ingot mould.

The choice of the nature of the mixing gas is generally a function of the aim pursued. Taking into account the small quantity of gas used, argon will be used preferably in spite of its relatively high price. To the extent that in certain cases a nitridation or a reoxidation of the steel in the ingot mould can be accepted. Nitrogen can also be used as the mixing gas and in the most favourable cases air can be used.

In proceeding in the above-mentioned manner, ingots of composite steel are obtained. These ingots have at the surface, that is to say in their skin, an alloy of metals corresponding to that prepared in the tapping ladle and at the interior, that is to say at the heart, an alloy of metals whose composition corresponds to the sum of the alloy prepared in the ladle and the supplementary elements added in the ingot mould and whose homogenization and digestion have been caused by the intense mixing, this composition being practically devoid of non-metallic residues which have been eliminated by the intense mixing and which would proceed from chemical reactions produced by the addition in the ingot mould of a deoxidizing agent such as silicon and/or other reducing agents, such as aluminium, used in small quantities. Thus composite ingots, whose steel in its heart is semi-killed or even killed and whose skin is respectively of effervescent or semi-killed steel, or more generally incompletely killed, are thus obtained.

In order to prevent any part of the inclusions coming to or being found at the surface of the liquid ingot from being entrained by the intense mixing towards the interior of the liquid ingot, it is advantageous to provide on the free surface of the liquid steel comprising the ingot, a more or less thick layer of synthetic slag which is not miscible with the steel and in which come to be dissolved or remain caught a part of the inclusions.

Numerous formulas for slag can be used and for example a slag having the following composition can be used:

| | | |
|---|---|---|
| $SiO_2$ = 35 % | CaO = 15 % | $Na_2O$ = 20 % |
| $TiO_2$ = 5 % | MnO = 20 % | MgO = 5 % |

This slag can be used with steel killed by aluminium in the ingot mould starting from effervescent steel.

A similar technique consists in adding to the free surface of the liquid steel a flux which will transform into a fluid liquid the pasty or even solid residues of deoxidation which are decanted in the course of the mixture or immediately at the end of the latter. This technique will be used, with advantage, particularly for the production of steel semi-killed by silicon with prior deoxidation by aluminium. This deoxidation produces in effect amounts of oxides rich in alumina which are very viscous and even sometimes solid. At the end of the mixing, these amounts which behave like thermal insulators, delay the solidification of the underlying steel often causing the formation of resurgences. This disadvantage disappears if a flux is added, which forms with the deoxidation residues a layer of liquid and flowable slag. After the end of the mixing, the solidification of the surface will take place in an homogenous manner, for all the surface will be covered by a thin layer of slag of a uniform thickness. The majority of the fluxes generally used in siderurgy are suitable, for example: calcium or sodium fluoride, cryolite, borax, alkaline oxides, sodium silicate or carbonate etc. which will be able to be used alone or in mixtures. Very good results are obtained when using, in particular, a mixture made up of 60% fluorspar and 40% sodium carbonate.

The invention will be illustrated by several exemplary embodiments:

EXAMPLE 1

Production of killed steel in the ingot mould starting from an extra mild effervescent steel in the ladle.

The initial steel includes the following composition:

| | |
|---|---|
| C = 0,051 % by weight | P = 0,013 % by weight |
| Mn = 0,33 % by weight | S = 0,013 % by weight |

Four ingots of killed steel are made by adding to the steel tapped in the ingot mould one kg of aluminium per tonne of steel the weight of each ingot being 10 tonnes and the height of each ingot being approximately 2 meters. In this particular case it is a question of flat dead-headed ingots. The filling time of each ingot moulds was respectively:

1 min 30 sec, 1 min 20 sec, 1 min 20 sec, 1 min 35 sec. After the end of the filling of the ingot moulds, there was a wait in each case of 30 seconds before adding the aluminium. This operation lasted 15 seconds.

The mixing of the steel with the help of the argon was effected as soon as the tapping of the steel into the ingot mould started; but the flow of the mixing gas was kept weak (50 l/min) until the moment of the addition of the aluminium. Starting from this moment an intense mixing was caused with a flow of gas of 150 l/min for a duration of 1 min 30.

After the addition of the aluminium, a substantial rise of deoxidation slags was ascertained. The composition by weight of these slags was as follows:

| | |
|---|---|
| $Al_2O_3$ = 82,1 % | FeO = 3,22 % |
| $Fe_2O_3$ = 9,2 % | MnO = 5,5 % |

From the end of the mixing, the heads of the ingots were covered with the quantity of exothermic powder normally used with this type of dead-headed ingot.

The four ingots were rolled into slab blooms and these slab blooms were subjected to an ultrasonic examination in order to determine the depth of the cavity at the head of each slab bloom. The following values were found, which are expressed in percentage of the total length of the slab bloom under consideration: 4,4% 3,1% 3,6% 3%

All the rest of the slab blooms were free from cavities and amounts of inclusions detectable by ultrasonics. The thickness of the skin of effervescent steel measured on the slab blooms varied between 5 mm (at the foot) and 3 mm (at the head).

The amount of aluminium and oxidized aluminium in the head and in the feet of the four ingots was determined. The results of this analysis are as follows:

| No. of ingot | Al metal % | | Al oxide % | |
|---|---|---|---|---|
| | Head | Foot | Head | Foot |
| 1 | 0,066 | 0,063 | 0,003 | 0,003 |
| 2 | 0,065 | 0,066 | 0,001 | 0,002 |
| 3 | 0,061 | 0,061 | 0,002 | 0,003 |
| 4 | 0,067 | 0,070 | 0,001 | 0,001 |

Numerous ingots were produced in the same manner and the same results were always obtained: VIZ:

low scrap at the head, due to the absence of cavities and inclusion amounts at the head of the ingot, low dispersion, that is to say good uniform distribution of the amounts of aluminium, very low content of oxidized aluminium.

It should be again noticed that, according to the height $h$ of the ingots ($h = 2$ m), the time $T_E$ available for the treatment should be, according to the above-mentioned experimental formula, of the order of four minutes. The condition: $(h/2) \leq t_A + t_D + t_B \leq T_E$, has been well adhered to since in this case $t_A + t_D + t_B = 30$ sec + 15 sec + 1 min 30 sec = 2 min 15 sec.

Moreover less good results were ascertained when the intense mixing was continued for four minutes after the addition of the aluminium. The ingots thus produced contained several amounts of rather voluminous alumina which were easily detectable by ultrasonics. It was a question of residues of deoxidation entrained into the interior of the ingot by the mixing, and which could not be totally decanted after the mixing, the steel containing, four minutes after the addition of the aluminium (thus almost five minutes after the end of the tapping), too many crystals.

These disadvantages were not detectd with the ingots the steel of which was mixed, at maximum, for three minutes after the end of the tapping into the ingot mould.

EXAMPLE 2

Production of ingots of killed steel starting from an effervescent steel, which ingots comprise a skin of a controllable thickness of effervescent steel.

A steel of the same composition as in the case of Example 1 was taken and it was cast into ingot moulds of the same type as those of Example 1, but instead of adding aluminium 30 seconds after the tapping, there was a wait of 1 min 30 sec. The thickness of the skin on the slab bloom, which was 3 mm at the head and 5 mm at the feet when the wait was 30 seconds before adding the aluminium, reached, in this case, 5 mm at the head and 7 mm at the foot.

EXAMPLE 3

Production of steel ingots killed by aluminium starting from a steel semi-killed or completely killed by silicon in the ladle.

Five dead-headed ingots of 9 tonnes were cast starting from a ladle of steel semi-killed by silicon and whose analysis on the tapping test piece taken at the end of the casting of ingot 2 included:

| | |
|---|---|
| C = 0,0110 | Mn = 0,612 |
| Si = 0,085 | P = 0,024 |
| S = 0,019 | |
| total $O_2$ = 0,011 | |

These five ingots were treated in the same manner, that is to say they were mixed first for 1 min starting from the end of the tapping, then at the end of 1 min, 5 kg aluminium were added while continuing the mixing. This mixture was made as a result of sacks of 1 kg thrown onto the surface of the steel and it lasted 15 seconds. This mixing was further continued for 1 min 45 sec. The total operation therefore lasted 3 minutes. A little time after the end of the addition there was seen to rise to the surface of the metal a substantial quantity of deoxidation slag principally comprising alumina. At the end of the mixing, there was added, onto the surface of the metal, the quantity of exothermic covering powder normally used for ingots of this type killed by aluminium in the ladle.

The metal obtained, laminated in blooms, proved to be sound to ultrasonics. The dosage of the total oxygen over five blooms coming from the central part of the five ingots was verified. The following results were found:

| | Ingot 1 | Ingot 2 | Ingot 3 | Ingot 4 | Ingot 5 |
|---|---|---|---|---|---|
| Total oxygen | 0,0047 % | 0,0038 % | 0,0052 % | 0,0042 % | 0,0032 % |

A substantial deoxidation caused by the treatment in the ingot mould was therefore obtained.

Several experiments effected starting from steels more or less charged with C, Si or Mn gave similar results, the total oxygen remaining always less than 0.006 % by weight. It is to be noted that a small amount of aluminium can be added to the ladle without departing from the limits of the process provided, naturally, that the steel is not completely deoxidized in the ladle. If this was the case, one could not, quite evidently, undertake the deoxidization in the ingot mould which is the aim of the present process.

EXAMPLE 4

Semi-killed ingots were produced starting from an effervescent steel in the ladle, this ingot having a skin free from silicon.

Five square ingots of 9.2 tonnes were cast each starting from a ladle of effervescent steel.

The height $h$ of the ingots was 2 m. The effervescent steel had the following contents by weight of C, Mn, P and S:

| | |
|---|---|
| C = 0,139 % | P = 0,029 % |
| Mn = 0,535 % | S = 0,022 % |

After the tapping of the five ingots, which tappings lasted respectively 2 min 30 sec, 2 min 35 sec, 2 min 55 sec, 3 min, 3 min 25 sec the natural effervescence was allowed to continue for one minute. Then, in order to transform this effervescent steel into semi-killed steel, four small bags of 1 kg ferrosilicon of 75 % silicon were added to the steel of each ingot mould. The addition of these four small bags took 15 seconds. The mixing of the steel was caused by the introduction of argon at the base of the ingot mould by means of two tubes placed between the base plate and the ingot mould. This mixing was started for greater convenience as soon as the tapping starts with the flow of mixing gas (argon) which would have only been necessary after the addition of the ferrosilicon. This flow was 120 l/min per tonne of steel was therefore maintained for the whole operation which lasted 4 min from the end of the tapping into ingot moulds.

Unlike Example 1 where all the time T available was not used for the treatment ($t_A + t_D + t_B \leq T_E$) now the operation was made to last as long as possible ($t_A + t_D + t_B = T_E$).

In fact $t_B$ must be as large as possible in the present case, for the silicates produced in this case are decanted much more slowly than the aluminates which were produced in Example 1.

A little time after the addition of the ferrosilicon and the start of the intense mixing, a small quantity of slag appeared on the surface of the steel. It could be seen that the quantity of the slag increased at the end of the mixing, for the silicates entrained by the mixing into the interior of the ingot could then rise rapidly. An analysis of this slag indicated the following contents by weight:

| | |
|---|---|
| $SiO_2$ = 30,3 % | FeO = 10,9 % |
| $Al_2O_3$ = 6,9 % | CaO = 2,6 % |
| MnO = 48,0 % | |

The heads of the ingots were convex and the difference of level between the centre and the edge of the ingot was estimated to be 25 mm.

These five ingots were rolled to a blooming section of 200 × 200 mm. The scrap caused by the blooming was respectively: 2,7% 2,6% 2,6% 1,6% 2,8%.

The examination of the blooms obtained by ultrasonics did not reveal any cavities. The contents of silicon determined at different levels of each bloom are indicated on the table below giving the distribution of silicon in the ingot.

| Position in the ingot in % of length of the ingot. | Number of the ingot 1 | 2 | 3 | 4 | 5 |
|---|---|---|---|---|---|
| at the head | 0,025% | 0,024% | 0,022% | 0,024% | 0,023% |
| at 20% from the head | 0,023% | 0,026% | 0,024% | 0,022% | 0,026% |
| at 40% from the head | 0,024% | 0,022% | 0,022% | 0,025% | 0,024% |
| at 60% from the head | 0,022% | 0,022% | 0,022% | 0,023% | 0,026% |
| at 80% from the head | 0,023% | 0,025% | 0,025% | 0,025% | 0,022% |
| at the foot | 0,025% | 0,023% | 0,023% | 0,022% | 0,025% |

EXAMPLE 5

Steel ingots semi-killed by silicon were provided starting from an effervescent steel in the ladle, the addition of FeSi being preceded by a limited addition of aluminium.

The steel produced with the help of the technique described with precision in Example 4 at a content of oxygen generally greater than 0.010 %, normal for a semi-killed steel but which can be judged too high for certain delicate products.

A variant which would permit the attainment of amounts of oxygen lower than those obtained by the technique according to example 4 just as well as by the conventional processes of production of semi-killed steel were therefore looked for.

The starting point was a tapping of effervescent steel in the ladle, whose analysis included:

C = 0.125 Mn = 0.472 P = 0.022 S = 0.024

Five ingots of 9.2 tonnes each were tapped. The ingots Nos. 2 and 4 were subjected to the treatment described in Example 4, that is to say that one minute from the end of the tapping they received an addition of 4 kg of FeSi and the mixing measured since the end of the casting lasted in all 4 minutes. These two ingots are intended to serve as control ingots.

Ingots Nos. 1, 3 and 5 were also mixed for 4 minutes, but one minute after the end of the tapping, an addition of 1.5 kg aluminium was added, then 3 minutes after the end of the tapping, when the mixing had entrained the decanting of the larger part of the alumina produced by the addition of aluminium, 2 kg of FeSi were added. In addition, between the addition of the aluminium and that of the ferrosilicon, 1.5 kg of a powder containing 60% fluor spar and 40% sodium carbonate were added. This powder is a flux intended to render liquid and flowable the residues of the deoxidation by aluminium. After the end of the mixing, these three ingots had a convex head, as did the two control ingots.

The five ingots after rolling were examined by ultrasonics. The result was satisfactory for the five ingots.

The total dosage of oxygen was measured on blooms in the zone corresponding to the centre of the ingot, it was found:

| | ingot 1 | ingot 2 (control) | ingot 3 | ingot 4 (control) | ingot 5 |
|---|---|---|---|---|---|
| Oxygen | 0,0076 % | 0,0129 % | 0,0067 % | 0,0118 % | 0,0071 % |

The difference is substantial between the two groups of ingots. To obtain just as low contents in oxygen by deoxidizing only by ferrosilicon, it would be necessary to aim at, in the ingot, a high content of silicon and the risk of having cavitated ingots would then be very great, and this would be so whether the silicon was placed in the ingot mould according to the technique in detail in Example 4 of whether it was added in the ladle according to the conventional method of production of semi-killed steels.

A large scale experiment permitted the comparison of the scrap of the steel produced according to the process of the invention to the scrap of the control ingots of effervescent steel on the one hand, and, of steel semi-killed in the ladle, on the other hand.

The performances realized by these three processes were:

steel obtained with the process in accordance with the invention: head scrap 2.9% average, effervescent steel: head scrap 5.4% average, steel semi-killed in ladle: head scrap 7.6% average.

The head scrap, of which it is a question of the scrap necessary to eliminate, in practice, any trace of cavities.

This large scale experiment also permitted the measurement of the consumption of argon necessitated by the process; it was 0.6 $m^3$ per ingot of 9 tonnes.

In order to state more precisely the influence of the improvement of the state of the surface which the process in accordance with the invention permits compared to the steel semi-killed in the ladle, they were rolled in pal beams of a type which is particularly delicate to produce, two castings obtained per each of the two processes: of steel semi-killed in the ladle, 180 m of pal beams had to be rectified out of a total of 1,240 m, as compared with the process in accordance with the invention, there was a need to rectify only 37 m out of 1,436 m rolled. In the two cases, it was a question of the same fault, open lines in the zone which is acted on the most in the course of the manufacture of this lamina.

The advantages which the process in accordance with the invention entails can easily be understood, this process was particularly appropriate for producing composite ingots either in steel semi-killed by silicon and having an effervescent steel skin, or in steel killed by aluminium having a very low content of combined aluminium (oxidized aluminium), at a maximum equal to 0.003% and an effervescent steel skin.

It will be understood that the present invention is susceptible to various modification changes and adaptations.

What is claimed is:

1. A process for producing a composite steel ingot having a steel composition at the skin which differs from that at the heart, said process comprising the steps of, tapping an incompletely killed steel from a tapping ladle into an ingot mold to completely fill the ingot mold, adding at a predetermined time after the filling of the ingot mold, a deoxidizing agent to the steel in the ingot mold; thereafter intensively mixing the steel in the ingot mold by injecting a gas into the steel near the bottom of the ingot mold for a period of time, in minutes, equal to at least half the height of the ingot in meters, and thence decanting the inclusions in the steel; said steps of adding the deoxidizing agent, intensively mixing the steel and decanting the inclusions being performed during the basaltic crystallization phase of the steel in the ingot mold.

2. A process as claimed in claim 1 wherein the time between the end of the tapping of the steel into the ingot mold and the end of the intensive mixing is, in minutes, at most equal to double the height of the ingot in meters.

3. A process as claimed in claim 1 including the step of incompletely killing the steel in the ladle prior to its being tapped into the ingot mold.

4. A process as claimed in claim 3 wherein said step of incompletely killing the steel comprises the step of using silicon exclusively to produce an incompletely killed steel in the tapping ladle.

5. A process as claimed in claim 1 wherein the steel is semi-killed when it is tapped from the tapping ladle into the ingot mold.

6. A process as claimed in claim 1 wherein the steel in the tapping ladle has a content of carbon and manganese of the characteristics of a semi-killed steel, but has an oxygen content characteristic of an effervescent steel and said step of adding a deoxidizing agent comprises the step of adding a deoxidizing agent containing silicon of a quantity sufficient to obtain semi-killed steel.

7. A process as claimed in claim 6, including the step of adding an aluminum deoxidizing agent of a quantity insufficient to reduce the content of oxygen of the steel to that corresponding to semi-killed steel prior to said step of adding the deoxidizing agent containing silicon.

8. A process as claimed in claim 7 including the step of adding, during the step of intensively mixing of the steel, a flux on the surface of the mixed steel to render liquid and flowable the residues of the deoxidization by the aluminum deoxidizing agent.

9. A process as claimed in claim 1 wherein said step of adding a deoxidizing agent comprises the step of adding aluminum in a quantity sufficient to obtain killed steel.

10. A process as claimed in claim 9 including the step of adding, during the step of intensively mixing of the steel, a flux on the surface of the mixed steel to render liquid and flowable the residues of the deoxidization by the aluminum deoxidizing agent.

11. A process as claimed in claim 1 including the step of covering the free surface of the liquid steel with a layer of synthetic slag immiscible with said steel.

* * * * *